US005918522A

United States Patent [19]

Benedict et al.

[11] Patent Number: 5,918,522

[45] Date of Patent: Jul. 6, 1999

[54] RADIAL ARM SAW BLADE GUARD

[75] Inventors: Charles E. Benedict, Tallahassee, Fla.; Douglas A. Newcomer, Commerce; Gregory W. Hatcher, Cairo, both of Ga.; Timothy M. Cheek; Douglas R. Stahl, both of Tallahassee, Fla.

[73] Assignee: Benedict Engineering Company, Inc., Tallahassee, Fla.

[21] Appl. No.: 08/884,665

[22] Filed: Jun. 27, 1997

Related U.S. Application Data

[60] Provisional application No. 60/020,890, Jun. 28, 1996.

[51] Int. Cl.[6] ..... B27B 5/20; B27G 19/02

[52] U.S. Cl. ..... 83/478; 83/397; 83/486.1

[58] Field of Search ..... 43/478, 486.1, 43/397, DIG. 1

[56] References Cited

U.S. PATENT DOCUMENTS

| | | | |
|---|---|---|---|
| 1,127,509 | 2/1915 | Pleasance . | |
| 4,581,966 | 4/1986 | Kaiser et al. | 83/397 |
| 4,672,746 | 6/1987 | Zeilenga . | |
| 4,693,008 | 9/1987 | Velie | 30/390 |
| 5,075,976 | 12/1991 | Young | 30/391 |
| 5,129,300 | 7/1992 | Kawakami | 83/471.2 |
| 5,287,779 | 2/1994 | Metzger, Jr. . | |
| 5,287,780 | 2/1994 | Metzger, Jr. et al. . | |
| 5,353,670 | 10/1994 | Metzger, Jr. | 33/471.3 |
| 5,370,025 | 12/1994 | Itzov | 83/397 |
| 5,531,147 | 7/1996 | Serban | 83/478 |
| 5,638,731 | 6/1997 | Garuglieri | 83/397 |
| 5,724,875 | 3/1998 | Meredith et al. | 83/397 |

FOREIGN PATENT DOCUMENTS 966065 8/1964 United Kingdom .

*Primary Examiner*—Rinaldi I. Rada
*Assistant Examiner*—T. Anthony Vaughn
*Attorney, Agent, or Firm*—Dowell & Dowell, P.C.

[57] ABSTRACT

A radial arm saw is provided with pairs of outside and inside lower blade guards which normally extend outwardly beyond the cutting blade of the saw. The lower blade guards are normally locked in covering relationship relative to the saw blade unless released by the operation of a safety lock assembly including a pair of pivotable stop members which are engageable with the lower blade guards. The safety lock assembly includes a handle for pivoting and releasing the stop members when the radial arm saw is used in a cross-cutting mode and a separate release rod which extends from the forward end of the saw assembly to the rear end thereof and which is operable to release the stop members when the saw is utilized in a rip cut mode.

18 Claims, 6 Drawing Sheets

20
24
26
28
84
44
45
59
82
74
60
32
78
62
64
46
22
72
34
40
48
50
30

28
44
36
82
84
34
114
38
60
78
58
52
62
64
50
46
40

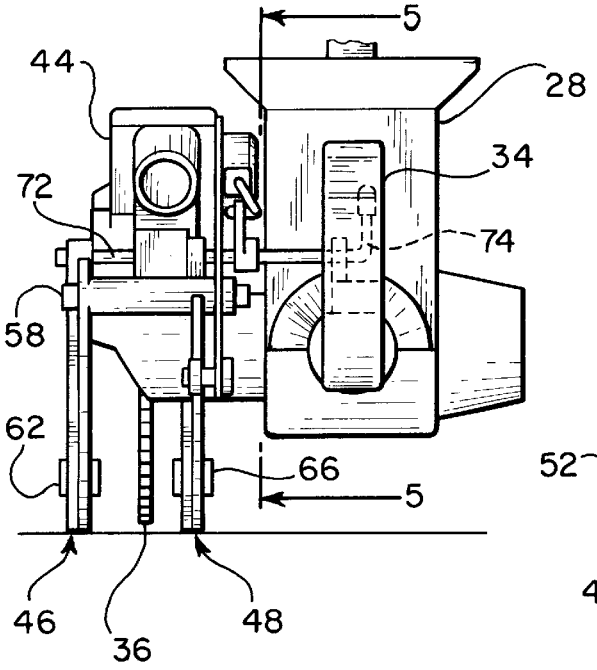
FIG. 3
FIG. 4
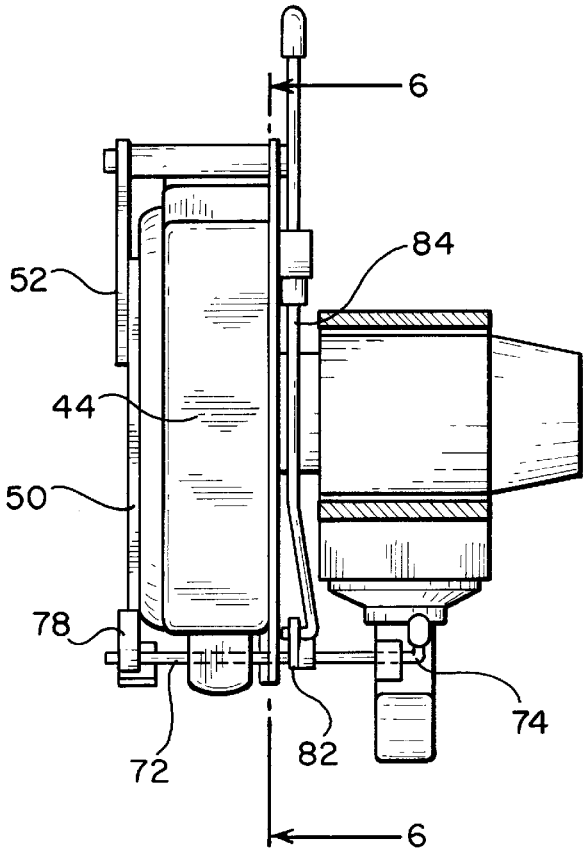
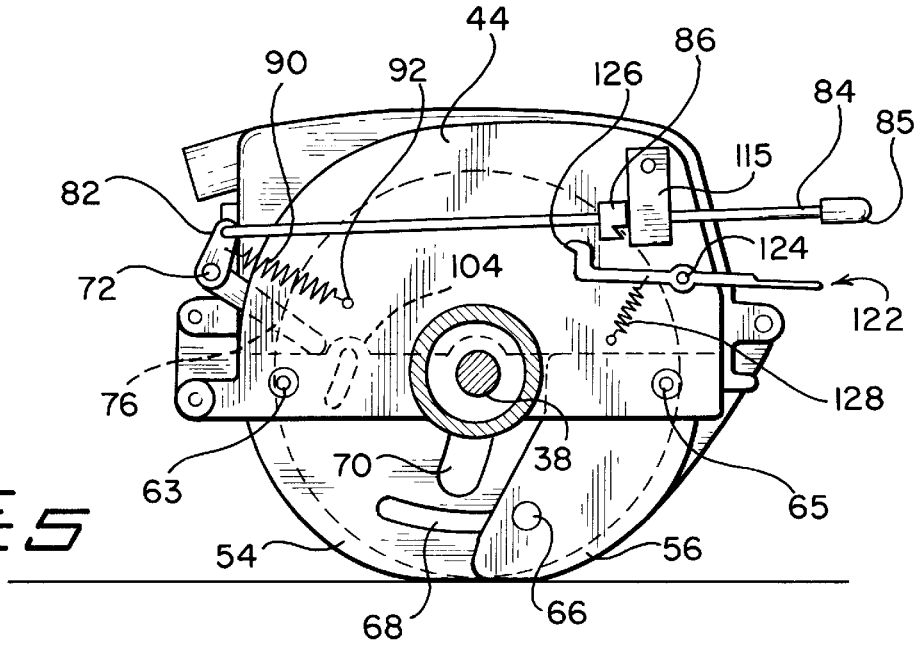
FIG. 5

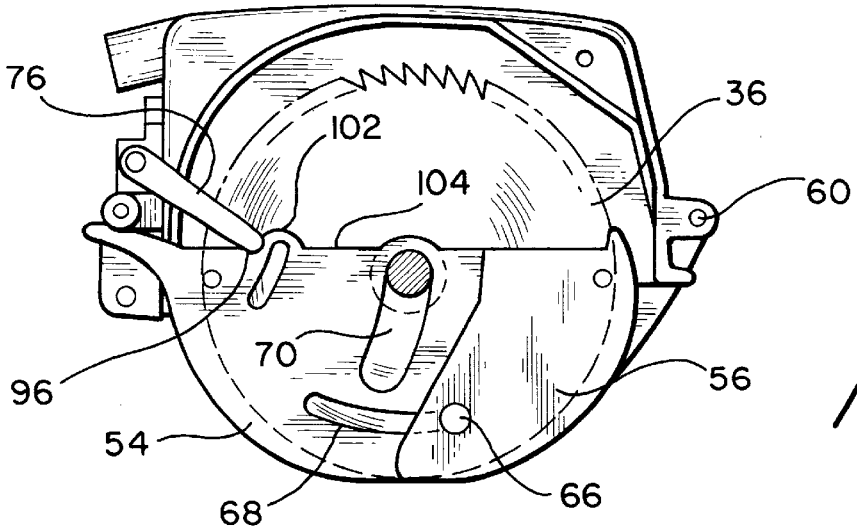
FIG. 6
FIG. 7
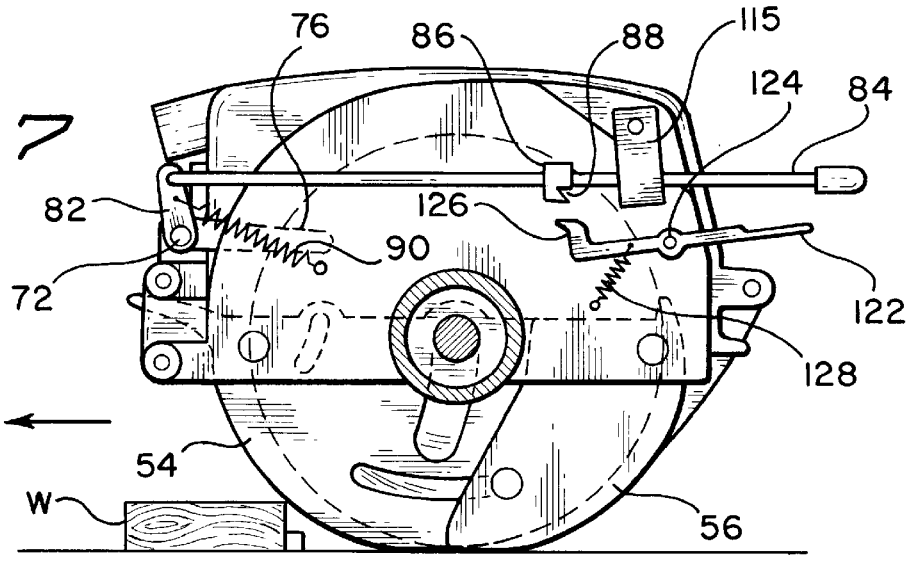
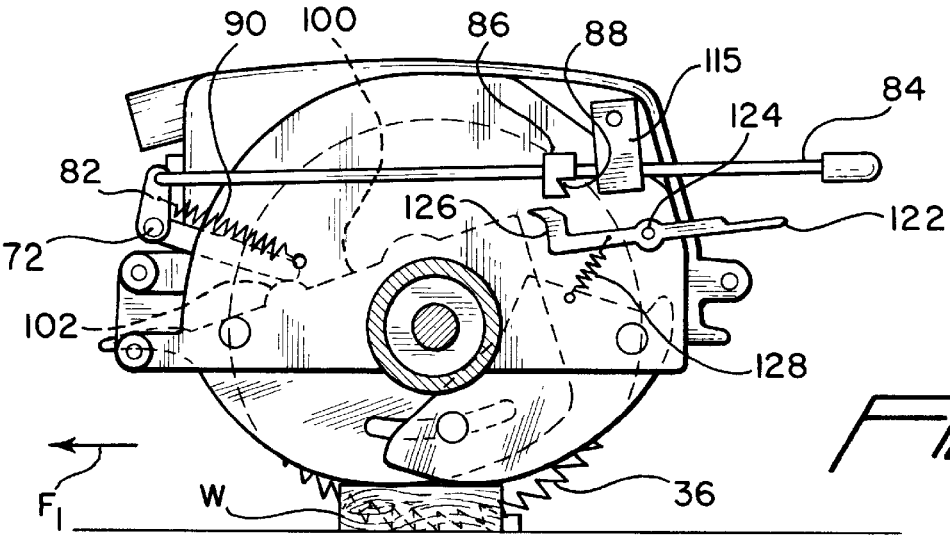
FIG. 8

RADIAL ARM SAW BLADE GUARD

CROSS-REFERENCE TO RELATED APPLICATION

This application is related to U.S. Provisional Application Ser. No. 60/020,890 filed Jun. 28, 1996.

BACKGROUND OF THE INVENTION

1. Field of the Invention

This invention is generally directed to safety guards for use with radial arm saws and, more particularly, to pivotable blade guards for protecting the lower edge of the cutting blade of a radial arm saw which are normally locked in a covering relationship with respect to the cutting blade unless manually released so that the lower guards elevate automatically by engagement of a workpiece in either a rip cut or crosscut mode.

2. History of the Related Art

Radial arm saws include a saw assembly mounted on a horizontal supporting arm positioned above a work table. The saw assembly is pivotal relative to the supporting arm to enable the saw to be selectively used in crosscutting or rip cutting modes. During crosscutting, the length of the workpiece is changed by making straight or angled cuts. The width of the workpiece is changed during rip cutting by cutting along its length. The saw is moved relative to a stationary workpiece during crosscutting, while the workpiece is moved relative to a stationary saw during rip cutting.

Both crosscutting and rip cutting have associated safety hazards due to the inherently dangerous nature of these operations. Crosscutting hazards include operator exposure to the rotating saw blade, rolling carriage and projected workpieces. These hazards pose chances of serious bodily injury to operators.

Rip cutting similarly exposes the operator to bodily injury due to contact with the rotating blade. Other hazards of rip cutting include workpiece kickback and wrong way feeding of the workpiece.

Thus, there is a need for a saw blade guard suitable for use on radial arm saws that provides reliable operator protection during both crosscutting and rip cutting operations.

Some examples of prior art safety guards for radial arm and circular type saws are disclosed in U.S. Pat. Nos. 1,127,509 to Pleasance, 4,672,746 to Zeilenga, 5,287,779 to Metzger, Jr. and 5,287,780 to Metzger, Jr. et al. as well as British Patent No. 966,075.

SUMMARY OF THE INVENTION

A radial arm saw includes a saw assembly having an upper blade guard housing in which a blade is rotated by a motor. Pairs of outer and inner lower blade guard sections are pivotally mounted to the forward and rear portions of the housing and are guidingly interconnected so that the sections on either side of the saw blade pivot inwardly relative to one another as they are raised to expose the saw blade during cutting in either a rip cut or crosscut mode. The invention includes a safety lock assembly for ensuring that the lower blade guard sections are retained in a lower covering relationship with respect to the saw blades at all times unless manually released by the saw operator. The safety lock assembly includes a pair of spaced stop members which are selectively engageable along the upper edge of both of the outside and inside lower blade guards. In the preferred embodiment, each of the stop members includes a bifurcated tip which is engageable with an edge portion of the forward lower blade guard sections. The outer blade guard is provided with a recessed area along the upper edge of the forward lower blade guard section in which the bifurcated end of one of the stop members is selectively seated such that the lower outer blade guard cannot be raised unless the stop member is pivoted free from the upper edge thereof. In a like manner, a projection is provided along the upper edge of the inner forward lower blade guard against which the other of the stop members is normally seated such that the inner lower blade guard sections cannot be raised until the stop member is raised from contact with the projection. The stop members are mounted to a linkage including a shaft from which a first manually operable release device or handle portion extends adjacent an ON/OFF switch of a handle associated with the saw assembly such that an operator may engage the handle at the same time that the power ON/OFF switch which operates the motor for the saw assembly is engaged. A spring mechanism is provided to normally retain the stop members in an engaged and locked position preventing any pivotal movement of the lower blade guards.

During operation of the saw in a crosscut mode, an operator engages the handle of the lock assembly at the same time the power ON/OFF switch is engaged. By pivoting the handle, the rod carrying the stop members is rotated, thereby pivoting the stop members to a release position in which the lower blade guard sections may be pivoted relative to the upper housing and toward one another on opposite sides of the saw blade as a workpiece is engaged by movement of the saw assembly relative to the workpiece.

The safety lock assembly further includes a second manually operable release device including a rod member mounted along one side of the upper housing which is connected to the pivot shaft to which the stop members are secured. The rod member extends substantially the full length of the upper housing and is utilized to pivot the pivot shaft and release the stop members from the opposite end or rear of the saw remote from the saw handle and ON/OFF trigger switch. A latch mechanism is mounted to the upper blade guard or housing and is utilized to retain the rod member in a position to release the stop members from engagement with the upper edges of the lower blade guards. The latch mechanism includes a resilient member for disengaging the latch mechanism from the rod member when the lower blade guard sections pivot upwardly by engagement with the workpiece, thus allowing the stop members to be free to pivot to their locking engagement with the upper edges of the lower blades guards after the workpiece has passed through the saw blade and the lower blade guard sections drop by gravity to their lower position, thus ensuring the safety lock is again engaged to prevent accidental displacement of the lower blade guard sections.

BRIEF DESCRIPTION OF THE DRAWINGS

In the accompanying drawings:

FIG. 3 is a front elevational view of the radial arm saw of FIG. 1;

FIG. 4 is a top plan view of the radial arm saw of FIG. 1;

FIG. 5 is a left side cross-sectional view taken along line 5—5 of FIG. 3;

FIG. 6 is a left side cross-sectional view taken along line 6—6 of FIG. 4;

FIG. 7 is a view similar to FIG. 5 showing the saw in the crosscutting mode prior to contact with a workpiece;

FIG. 8 is a view similar to FIG. 7 during crosscutting of the workpiece;

DETAILED DESCRIPTION OF THE PREFERRED EMBODIMENT

Figure 1:
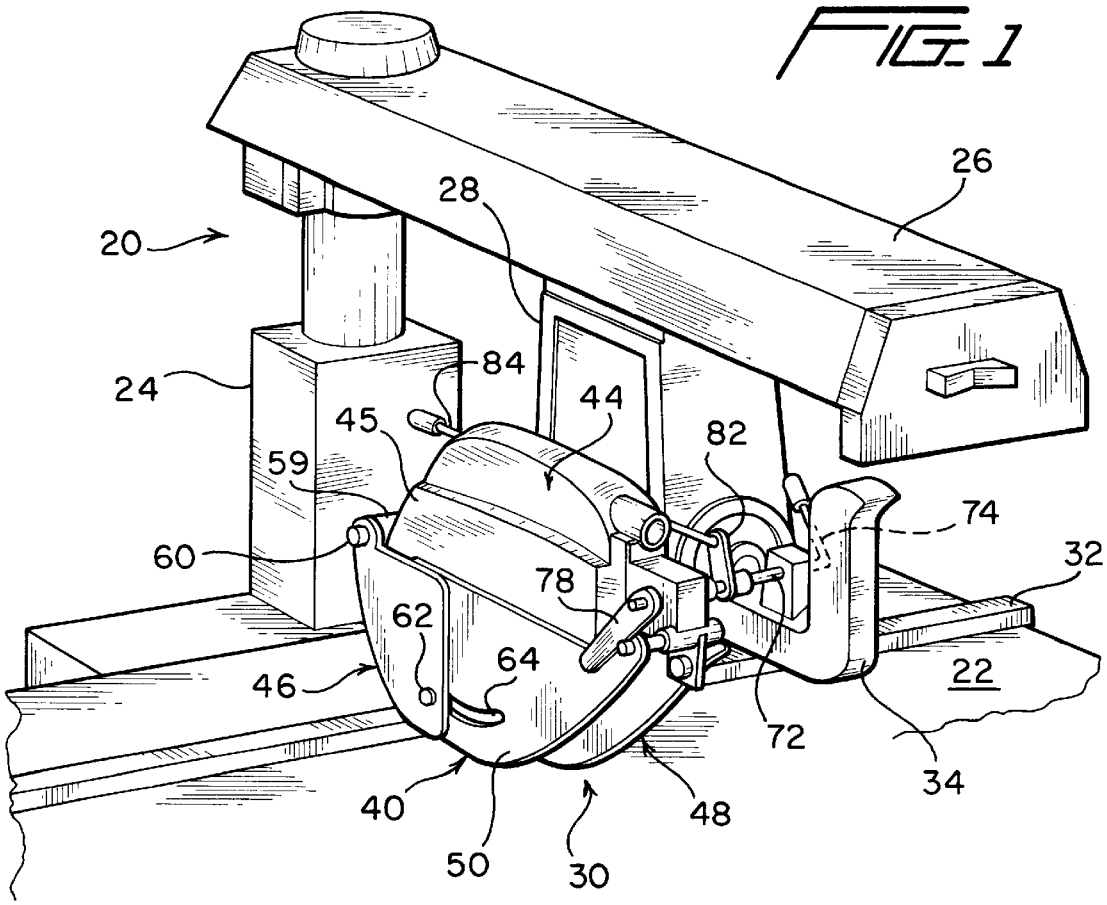
FIG. 1 is a front perspective view of a radial arm saw with an installed lower saw blade guard in accordance with the invention.

FIG. 1 illustrates a conventional radial arm saw 20 having an installed lower saw blade guard 40 in accordance with the invention. The radial arm saw 20 is comprised of a work table 22, a vertical support 24 and a horizontal support arm 26 which overhangs the work table. A yoke 28 extends downwardly from the support arm 26. A saw assembly 30 is rotatably and slidably mounted to the yoke 28. A fence 32 is provided on the work table 22.

The radial saw assembly 30 may be operated in either the crosscutting or the rip cutting mode. FIG. 1 illustrates the crosscutting mode in which the radial saw assembly is parallel to the horizontal support arm 26. In this mode, the radial saw assembly and the yoke supporting it are slidably movable along the horizontal support arm.

The radial saw assembly 30 is positioned in the rip cutting mode by rotating the radial saw assembly so that it is perpendicular to the horizontal support arm (not shown). In the rip cutting mode, the radial saw assembly and yoke 28 are stationary and the workpiece is fed into the saw blade to vary the width of the workpiece.

The radial saw assembly 30 comprises a housing 44 which includes a fixed upper saw blade guard 45 which surrounds an upper portion of the motor driven saw blade 36 mounted on a drive shaft 38, and an operating handle 34 which is grasped by the operator to move the radial saw assembly in the crosscutting mode.

The lower saw blade guard 40 is provided to prevent the operator from accidentally contacting the rotating saw blade. Referring to FIG. 1, the lower saw blade guard 40 includes an outside lower guard 46 for covering one side of the saw blade and an inside lower guard 48 for covering the opposite side of the saw blade. The outside lower guard 46 includes a front guard section 50 and a rear guard section 52. Referring to FIG. 5, the inside lower guard 48 includes a front guard section 54 and a rear guard section 56.

Figure 9:
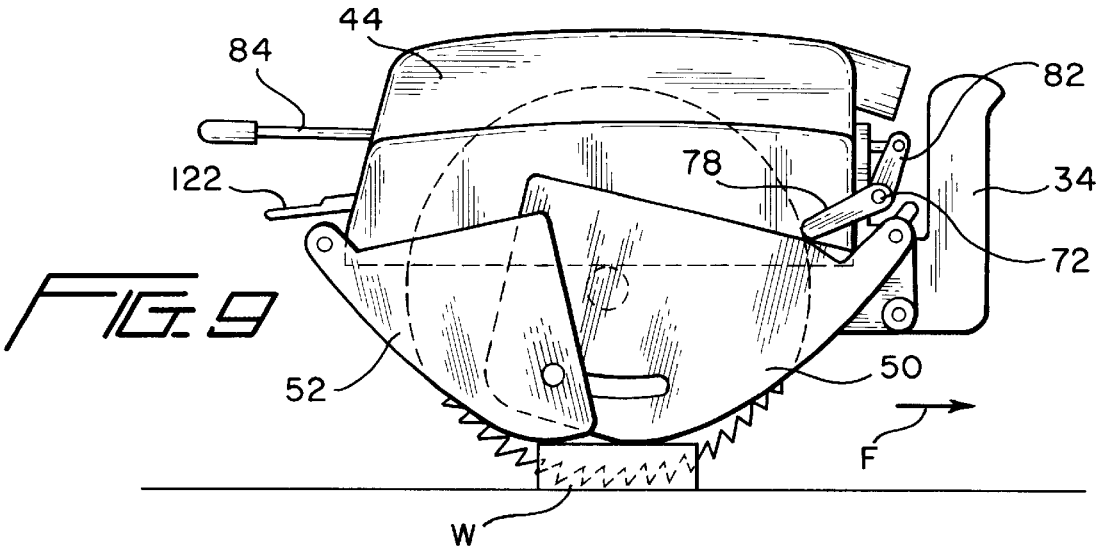
FIG. 9 is a right side view of the radial saw assembly of FIG. 8 during crosscutting of the workpiece.

Referring to FIG. 1, the front guard section 50 is pivotally connected to a front portion of the housing 44 by a pivot pin 58, and the rear guard section 52 is pivotally connected to a rear portion 59 of the housing by a pivot pin 60. The front and rear lower guard sections 50, 52, respectively, are also pivotal relative to each other when a safety lock assembly, described below, is released. A pin 62 is provided on the rear lower guard section 52 and an arcuate slot 64 is formed in the front lower guard section 50. As shown in FIG. 9, the pin 62 moves along the slot 64 as the guard section 46 is raised by contact with a workpiece W as the radial saw assembly 30 is moved forwardly during crosscutting in the direction of the arrow F.

The inside lower guard 48 protects the inside of the saw blade, as shown in FIG. 7. The front guard section 54 is pivotally connected to the upper blade guard 45 by a pin 63, and the rear guard section 56 is pivotally connected to the upper blade guard by a pin 65. A pin 66 is provided on the rear guard section 56 and an arcuate slot 68 is formed in the front guard section 54. A generally vertical arcuate slot 70 is also formed in the front guard section 54. The motor drive shaft 38 extends through the slot 70. Referring to FIG. 8, the pin 66 moves within the slot 68, and the slot 70 moves relative to the drive shaft 38, when the lower guard section 48 is raised by contact with the workpiece "W" as the radial saw assembly 30 is moved forwardly in the direction of the arrow $F_1$.

In accordance with the invention, the lower saw blade guard 40 includes a safety lock assembly for preventing the lower saw blade guard from being accidentally raised to expose the saw blade 36 except during cutting operations when the saw guards contact a workpiece. The safety lock assembly includes a latch mechanism for use in the rip cutting mode as will be described hereinafter. The latch mechanism is preliminarily set by the operator before rip cutting and is automatically released when the lower saw blade guard 40 contacts the workpiece, allowing the lower saw blade guard to pivot upwardly so as to expose the saw blade.

Figure 16:
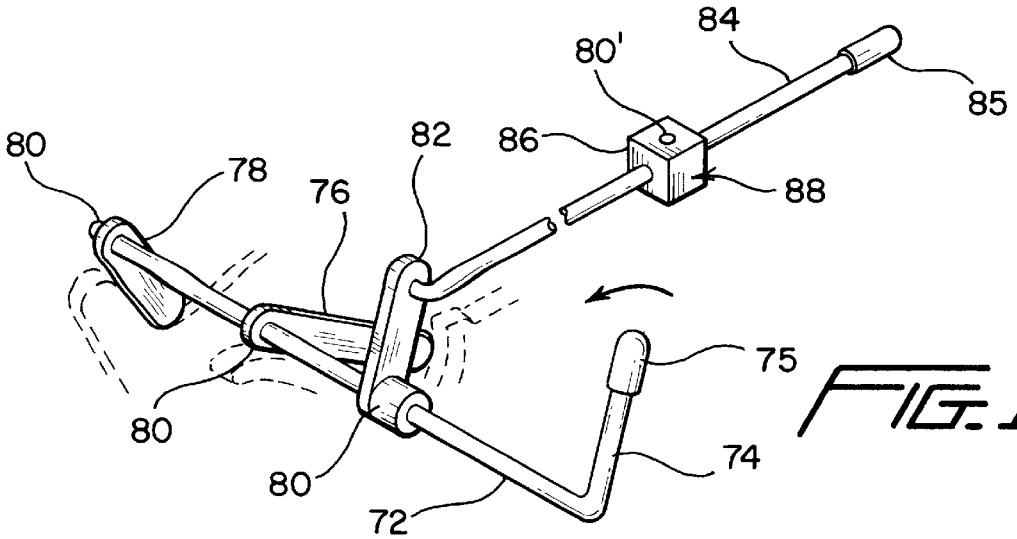
FIG. 16 a perspective view illustrating the lower saw blade guard safety locking mechanism and portions of the lower saw blade guards in broken line.

Referring to FIG. 16, the safety lock assembly includes a linkage system including a shaft 72. A first manually operable release element or handle 74 extends from the shaft and includes a cover 75 at one end. The handle portion 74 is located adjacent to the handle 34 to which the saw power ON/OFF trigger is mounted to thus enable the operator to operate both simultaneously. A first stop 76 and a second stop 78 are fixedly mounted to the shaft 72 by fasteners 80 such as set screws. The first stop 76 is associated with the inner front guard section 54 and the second stop 78 is associated with the outer front guard section 50. As shown, the first and second stops are mounted to the shaft 72 at different angular orientations with respect to each other.

A connector 82 is fixedly mounted to the shaft 72 by another fastener 80 between the handle 74 and the first stop 76. A second manually operable release device is attached to the stop members by way of the linkage system. The second manually operable release device includes a rod 84 pivotally attached to the connector 82 and extends rearwardly therefrom. A cover 85 is provided on the rear end of the rod 84. An abutment member 86 having a cut-out portion 88 is fixedly mounted to the rod by a fastener 80'.

Figure 12:
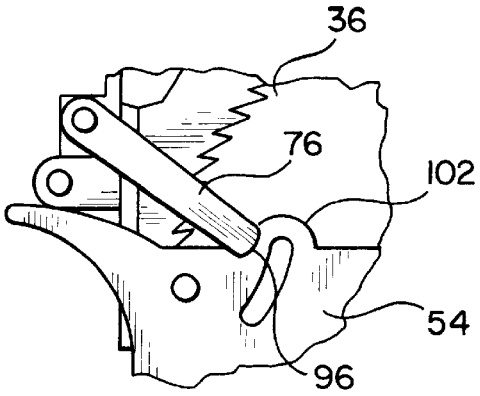
FIG. 12 is an enlarged view of a first stop in an engaged locking position with respect to one of the front lower blade guards.

FIGS. 5 and 12 illustrate the first stop 76 in the engaged position in which the lower saw blade guard sections are fully lowered. The first stop 76 is located inside of the upper saw blade guard 45 of the housing 44. A spring 90 is attached to the upper saw blade guard at end 92 and to the connector 82 at the opposite end. The spring 90 resiliently biases the connector 82 in the clockwise direction so as to maintain the first stop 76 in the engaged position.

Figure 17:
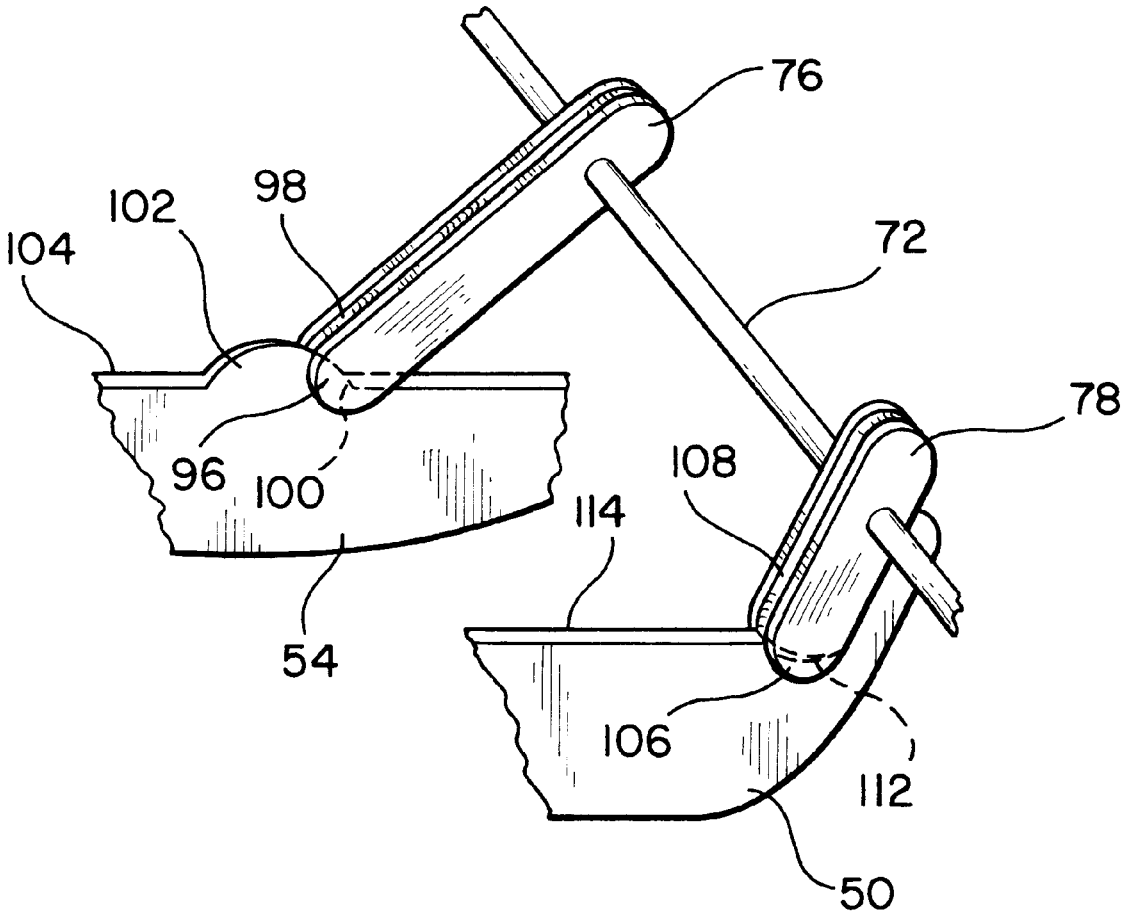
FIG. 17 is a perspective view illustrating the bifurcated tip configuration of the first and second stops of FIGS. 12–16.

Referring to FIGS. 16 and 17, the first stop 76 has an arcuate shaped, bifurcated tip 96 which defines a groove 98. The groove 98 is sized to receive an arcuate surface 100 formed on a projection 102 on the top surface 104 of the front guard section 54 in the engaged position of the first stop 76. The engagement between the bifurcated tip 96 of the first stop 76 and the protrusion 100 prevents accidental rotation of the inner front guard section 54 and, accordingly, also the inner rear lower guard 56, relative to the housing 44. FIGS. 6, 12 and 16 also show the engagement of the first stop 76 and the projection 100.

Figure 13:
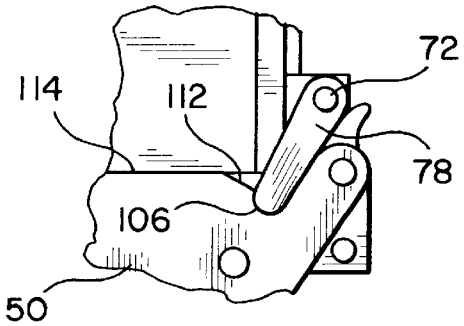
FIG. 13 is an enlarged view of a second stop in an engaged locking position with respect to another front lower blade guard.

FIGS. 1, 2, 9, 13, 16 and 17 illustrate the operation of the second stop 78 of the safety lock assembly. Referring to FIGS. 16 and 17, the second stop has an arcuate shaped tip 106 which defines a groove 108. The groove 108 is shaped and sized to firmly engage a recessed arcuate surface 112 formed on the top surface 114 of the outer front guard section 50 in the engaged position of the second stop 78, as shown in FIGS. 1 and 13. The second stop 78 is engaged with the outer front guard section 50 simultaneously with the first stop 76 being engaged with the inner front guard section 54. The engagement between the tip 106 of the second stop 78 and the arcuate surface 112 prevents accidental rotation of the outer front guard section 50 and, accordingly, also the outer rear guard section 52, relative to the housing 44.

Figure 2:
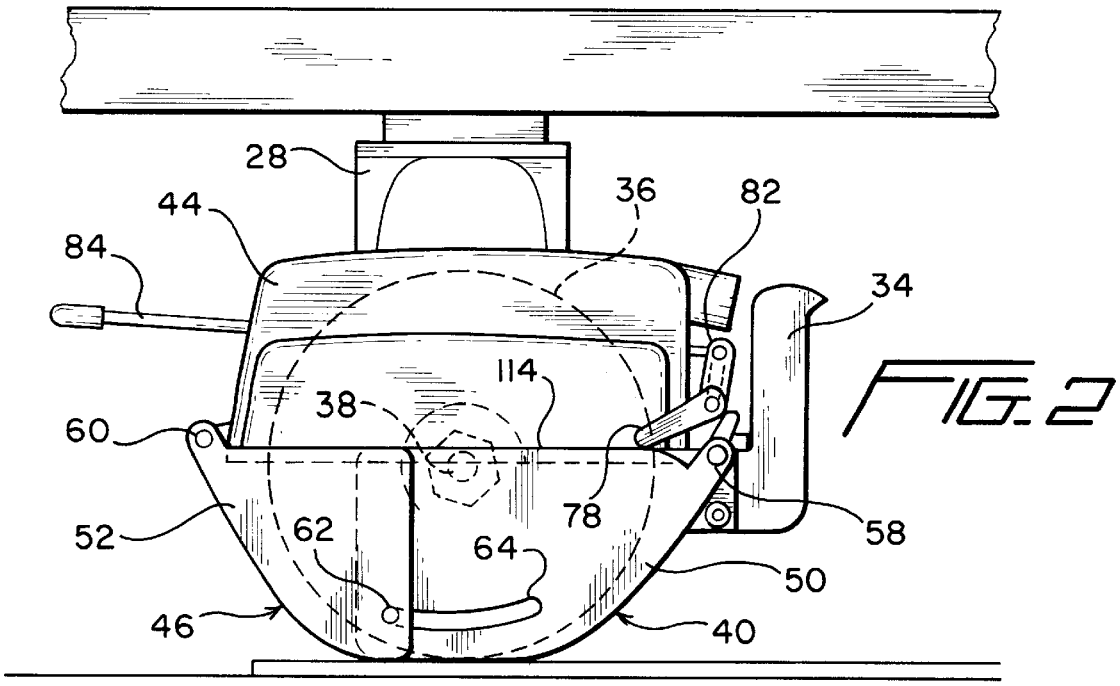
FIG. 2 is a partial right side elevational view of the radial arm saw of FIG. 1.
Figure 14:
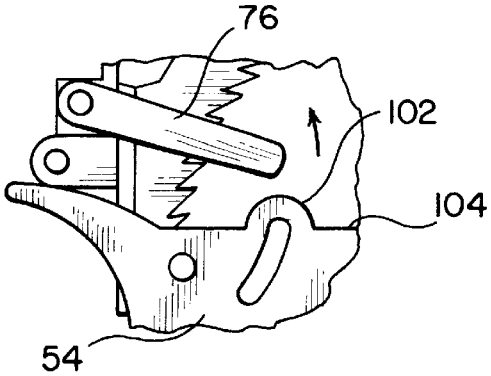
FIG. 14 illustrates the first stop of FIG. 12 in the released position.
Figure 15:
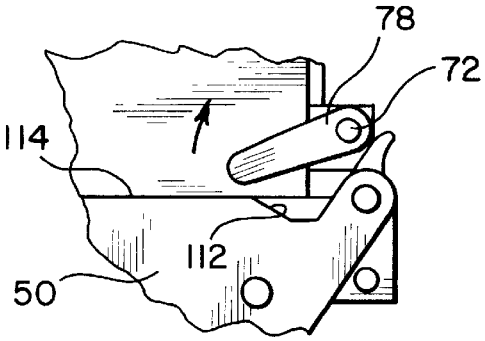
FIG. 15 illustrates the second stop of FIG. 13 in the released position.

Referring to FIG. 5, the abutment member 86 on the rod 84 engages a limit stop 115 mounted on the upper guard portion of the housing when the first and second stops are in their respective engaged positions. To release the first and second stops, the operator rotates the handle portion 74 counterclockwise as depicted by the arrow in FIG. 16 thereby disengaging the first and second stops 76, 78 from the respective front guard sections 48, 46. The released position of the first stop 76 is shown in FIGS. 7 and 14, and the simultaneous released position of the second stop 78 is shown in FIGS. 2 and 15. Once the stops are released, the lower blade guard sections are free to automatically be raised when contact is made by a workpiece with the radial arm saw used in either a rip cut or crosscut mode.

FIG. 7 illustrates the front guard section 54 and the rear guard section 56 before contact with the workpiece "W". FIG. 8 shows the guard sections 54, 56 in raised positions as the saw blade 36 cuts through the workpiece.

Figure 10:
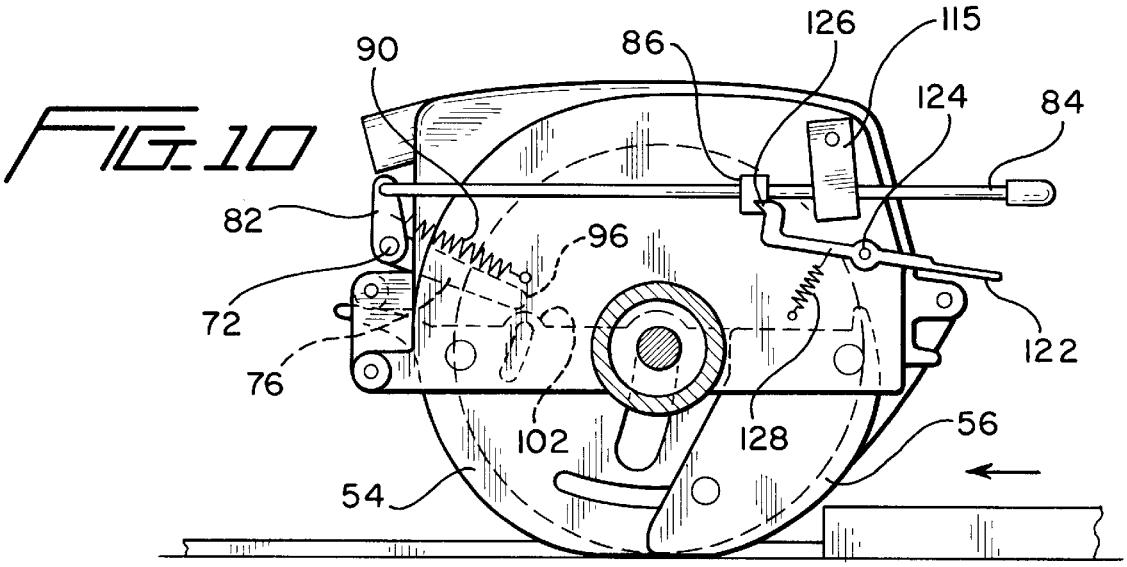
FIG. 10 is a view similar to FIG. 5 in the rip cutting mode prior to contact with a workpiece.
Figure 11:
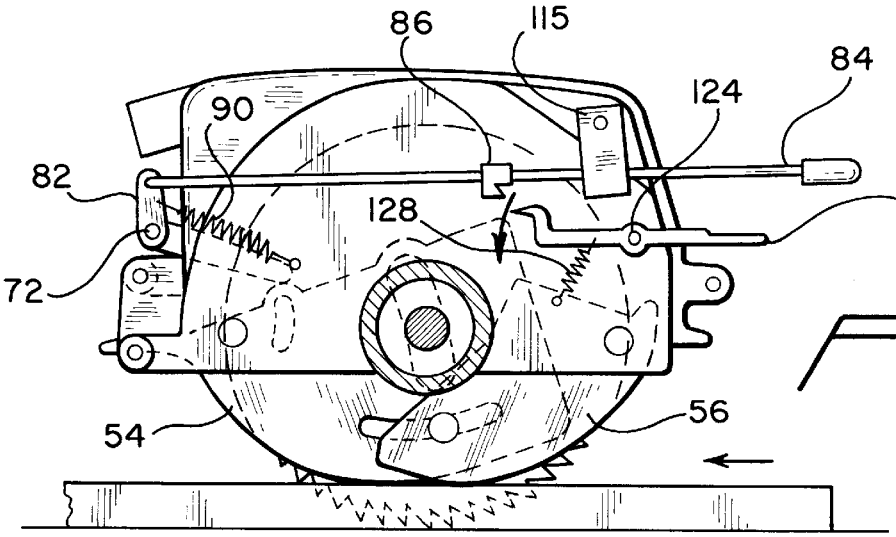
FIG. 11 is a view similar to FIG. 10 during rip cutting of the workpiece.

When the radial arm saw is to be used in a rip cutting mode, it is not possible for the operator to physically operate the stop release handle 74 as the operator must be positioned to push the workpiece "W" forward and past the saw blade, as illustrated in FIGS. 10 and 11. The operator is thus positioned on the opposite end of the saw assembly from the On/OFF trigger associated with the saw handle 34. Therefore, a latch mechanism 122 is provided for retaining the safety lock assembly in a position in which the stops 76 and 78 are in their disengaged position to allow the lower blade guard sections to pivot upwardly when contact is made with the workpiece.

The latch mechanism 122 is pivotally mounted to the housing by a pin 124. The latch 122 has an inclined front end portion 126 shaped to cooperatively engage in the cut-out portion 88 of the abutment 86 mounted on the rod 84 when the latch mechanism is set, as depicted in FIG. 10. A spring 128 attached to the latch 122 forwardly of the pin 124 resiliently biases the latch in the counterclockwise direction to thereby positively urge the rod 84 forwardly and thereby pivoting the handle 74 to the release position of the safety lock, as previously described.

To set the latch mechanism prior to rip cutting a workpiece, the operator pushes the rod 84 forwardly to place the first and second stops 76, 78, respectively, in slightly disengaged positions shown in FIGS. 7 and 2, respectively. The inclined end portion 126 of the latch 122 is moved into engagement with the cut-out portion 88 of the abutment 86. The spring 90 acts to hold the latch firmly engaged with the abutment 86 due to the mating shapes of the inclined end portion 126 and the cut-out portion 88. This action releases the lower guards to pivot upwardly and ride on the top face of the workpiece during rip cutting.

Referring to FIG. 11, as rip cutting begins, the rear guard section 50 contacts the workpiece "W" and pivots clockwise about the pin 65 and the front guard section 52 simultaneosly pivots counterclockwise about the pin 63. As the front guard section 52 pivots, the first stop 76 rides over the raised portion 102, urging the rod 84 forwardly. Forward movement of the rod 84 releases the latch mechanism 122 from engagement with the abutment 86. Once released, the latch 122 pivots downwardly away from the rod as depicted by the arrow in FIG. 11 due to the force exerted by spring 128. The stops 76 and 78 are thus released to pivot to their locking position as soon as the lower blade guard sections drop to their lower position covering the saw blade and can only be released again by operation of the handle 74 or the push rod 84.

The foregoing description of the preferred embodiment of the invention has been presented to illustrate the principles of the invention and not to limit the invention to the particular embodiment illustrated. It is intended that the scope of the invention be defined by all of the embodiments encompassed within the following claims and their equivalents.

We claim:

1. In a radial arm saw including a housing having front, rear and opposite side portions, a cutting blade mounted within the housing and rotated by a motor such that a lower portion of the cutting blade extends below the housing and wherein an operator's handle extends from the front of the housing, the improvement comprising:

inner and outer lower blade guards each including front and rear blade guard sections pivotally mounted to the housing so as to be moveable upwardly and toward one another when raised from a lower position in covering relationship on opposite sides of the lower portion of the cutting blade to a raised position allowing passage of a workpiece in cutting relationship to the cutting blade;

a safety lock assembly mounted to the saw and including stop members which engage said inner and outer lower blade guards to prevent the pivotal movement of said front and rear blade guard sections to thereby retain said front and rear blade guard sections in said lower position, and said safety lock assembly further including manually operable release means for moving said stop members relative to said inner and outer lower blade guards to thereby permit said front and rear blade guard sections to be pivoted to said raised position by contact with the workpiece.

2. The radial arm saw assembly of claim 1 in which said manually operable release means includes a shaft member to which each of said stop members is mounted so as to be pivotable therewith and a handle portion extending from said shaft member and selectively engageable so as to rotate said shaft member to thereby pivot said stop members relative to said inner and outer lower blade guards from a first position wherein said stop members engage said inner and outer lower blade guards to a second position wherein said stop members are spaced from said inner and outer lower blade guards.

3. The radial arm saw assembly of claim 2 including a first resilient means mounted to said housing, said first resilient means being connected to said shaft member so as to normally retain said stop members in said first position.

4. The radial arm saw assembly of claim 3 in which said manually operable release means includes a release rod having a first end mounted to said shaft member and a second end extending outward therefrom, said release rod being manually engageable to urge said stop members from said first position toward said second position.

5. The radial arm saw assembly of claim 4 including a latch mechanism mounted to said housing, said latch mechanism being engageable with said release rod so as to retain said release rod in a position to urge said stop members toward said second position from said first position thereof, and second resilient means mounted to said housing for urging said latch mechanism away from said release rod when said stop members are moved to said second position.

6. The radial arm saw assembly of claim 5 in which said handle portion is mounted adjacent the operator's handle of the radial arm saw and said first end of said release rod is pivotally mounted to said shaft member adjacent the front of the housing and said second end thereof extends from the rear of the housing.

7. The radial arm saw assembly of claim 6 including an abutment member mounted to said release rod, said abutment member being engageable by said latch mechanism when said release rod is moved so as to urge said stop members from said first position toward said second position thereof.

8. The radial arm saw assembly of claim 6 in which each of said front blade guard sections includes an upper edge, said front blade guard section of said outer lower blade guard having a recess formed in said upper edge thereof in which one of said stop members is selectively seated when in said first position, and said front guard section of said inner lower blade guard including a projection along said upper edge thereof against which the other of said stop members is engageable when said stop members are in said first position.

9. The radial arm saw assembly of claim 8 in which each of said front blade guard sections of said inner and outer lower blade guards includes an arcuate slot therein, a pin member extending from each of said rear blade guard sections of said inner and outer lower blade guards and being guided within said slots formed in said front blade guard sections, whereby said front and rear blade guard sections of said inner and outer lower blade guards, respectively, are guidingly connected in pivotal relationship with respect to one another.

10. The radial arm saw assembly of claim 8 in which each of said stop members includes a bifurcated end portion for engaging said upper edges of said front blade guard sections of said inner and outer lower blade guards, respectively.

11. In a radial arm saw including a housing having front, rear and opposite side portions, a cutting blade mounted within the housing and rotated by a motor such that a lower portion of the cutting blade extends below the housing and wherein an operator's handle extends from the forward portion of the housing, the improvement comprising:

inner and outer lower blade guards each including front and rear blade guard sections pivotally mounted to the housing so as to be moveable upwardly and toward one another when raised from a lower position on opposite sides of and in covering relationship with respect to the lower portion of the cutting blade to a raised position allowing passage of a workpiece in cutting relationship to the cutting blade;

a safety lock assembly mounted to the saw and including stop members which engage said outer and inner lower blade guards to prevent the pivotal movement of said front and rear blade guard sections to thereby retain said front and rear blade guard sections in said lower position, said safety lock assembly further including first and second manually operable release means for moving said stop members from said inner and outer lower blade guards to thereby permit said front and rear blade guard sections to be pivoted toward said raised position, said first manual release means including a handle portion mounted adjacent the handle of the radial arm saw adjacent the front of the housing and said second manually operable release means including an elongated rod member extending from said front portion of the housing toward the rear portion of the housing and which is moveable in order to selectively pivot said stop members from said first position toward said second position; and linkage means for connecting said stop members to said first and second manually operable release means.

12. The radial arm saw assembly of claim 11 including a latch mechanism for retaining said second manually operable release means in a position to retain said stop members spaced from said first position toward said second position, said latch mechanism being operable when said stop members are moved to said second position to thereby release said second manually operable release means to allow said stop members to return to said first position when said front and rear blade guard sections are pivoted to said lower position thereof.

13. The radial arm saw assembly of claim 12 including resilient means for biasing said linkage means to urge said stop members toward said first position.

14. The radial arm saw assembly of claim 13 including means for guiding by connecting said front and rear blade guard sections of each of said inner and outer lower blade guards in pivotal relationship with respect to one another.

15. The radial arm saw assembly of claim 13 in which each of said front blade guard sections of said inner and outer lower blade guards includes an upper edge, said front blade guard section of said outer lower blade guard having a recess formed in said upper edge thereof in which one of said stop members is selectively seated when in said first position and said front blade guard section of said inner lower blade guard including a projection along said upper edge thereof against which the other of said stop members is engageable when said stop members are in said first position.

16. A safety lock assembly for use on a radial arm saw wherein the radial arm saw includes a housing having front, rear and opposite side portions, a cutting blade mounted within the housing and rotated by a motor such that a lower portion of the cutting blade extends below the housing, inner and outer lower blade guards pivotally mounted relative to said housing for covering the lower portion of the cutting blade, the safety lock assembly comprising:

a pair of stop members which are adapted to be pivotally mounted relative to the housing so as to be selectively engageable with the inner and outer lower blade guards, a first manually operable release means, and a linkage means for connecting said first manually operable release means to said stop members whereby said stop members are adapted to be moved from a first position in engagement with the upper edge of the inner and outer lower blade guards to a second position raised relative to said first position to thereby permit the lower blade guard members to pivot upwardly with respect to the housing when the safety lock assembly is mounted to the radial area saw.

17. The safety lock assembly of claim 16 including a second manually operable release means connected to said linkage means and being adapted to extend from the front portion of the saw to the rear portion thereof and being operable to urge said linkage means to move said stop members from said first position toward said second position.

18. The safety lock assembly of claim 17 including a latch mechanism, means for mounting the latch mechanism to the housing, said latch mechanism being selectively engageable with said second manually operable release means to retain said second manually operable release means in a position to move said stop members from said first position toward said second position, and biasing means for releasing said latch mechanism from said second manually operable release means as said stop members move to said second position.

* * * * *